US007008138B2

(12) United States Patent
Burnes et al.

(10) Patent No.: US 7,008,138 B2
(45) Date of Patent: Mar. 7, 2006

(54) FACETED END CAP FOR LEACHING CHAMBER

(75) Inventors: James J Burnes, Deep River, CT (US); Ronald P. Brochu, Westbrook, CT (US); James M Nichols, Old Saybrook, CT (US)

(73) Assignee: Infiltrator Systems INC, Old Saybrook, CT (US)

( * ) Notice: Subject to any disclaimer, the term of this patent is extended or adjusted under 35 U.S.C. 154(b) by 0 days.

(21) Appl. No.: 10/677,771

(22) Filed: Oct. 1, 2003

(65) Prior Publication Data

US 2005/0074285 A1 Apr. 7, 2005

(51) Int. Cl.
*E02B 11/00* (2006.01)

(52) U.S. Cl. ..... 405/46

(58) Field of Classification Search ..... 405/43, 405/44, 45, 46, 47, 48, 49; 210/170
See application file for complete search history.

(56) References Cited

U.S. PATENT DOCUMENTS 2,153,789 A * 4/1939 Carswell et al. ..... 405/48
5,087,151 A * 2/1992 DiTullio ..... 405/43
5,156,488 A * 10/1992 Nichols ..... 405/48
5,441,363 A * 8/1995 Gray ..... 405/49
5,556,231 A * 9/1996 Sidaway et al. ..... 405/48
5,624,123 A 4/1997 Meyers ..... 277/602
5,839,844 A * 11/1998 Nichols et al. ..... 405/43
5,882,014 A 3/1999 Gavin ..... 277/9
6,129,482 A * 10/2000 Ditullio ..... 405/43
6,270,287 B1 * 8/2001 Gray ..... 405/100
6,612,777 B1 * 9/2003 Maestro ..... 405/49
6,719,490 B1 * 4/2004 Maestro ..... 405/46
2002/0025226 A1 * 2/2002 Maestro ..... 405/43
2002/0067952 A1 6/2002 Crescenzi et al. ..... 405/36

* cited by examiner

*Primary Examiner*—Michael Safavi
(74) *Attorney, Agent, or Firm*—C. Nessler

(57) ABSTRACT

A molded thermoplastic domed end cap, for attachment to the end of an arch shape cross section leaching chamber or stormwater chamber, has a multiplicity of buttresses, to provide facet surfaces where pipe connections may be made. The essentially planar surface portions have tear out or cut out regions, for pipe openings. The buttresses face in different directions, relative to the longitudinal axis of the end cap, to conveniently accommodate pipes running in different angular directions. Pipes, which pass through openings in the surfaces of the buttresses, are supported by molded in step-saddles of the buttresses. Molded in stops limit inward motion of pipes.

15 Claims, 4 Drawing Sheets

FACETED END CAP FOR LEACHING CHAMBER

TECHNICAL FIELD

The present invention relates to molded plastic chambers for receiving and dispersing water in soil or other granular media, in particular to end closures for such.

BACKGROUND

Buried leaching chambers are most commonly used for dispersing wastewaters beneath the surface of ground. Such type chambers may also be used for draining earth or other media. Buried stormwater chambers are used for receiving water, typically from storm, retaining the waters, and then dispersing them, usually by percolation. Commercially popular chambers of such types are made of molded thermoplastic, most commonly by injection molding. Typically they have arch shape cross sections and are coupled end to end at joints to form a string or row of chambers. The ends of the first and last chambers of a string or row have to be closed by end plates or end caps, to keep the surrounding media from entering the chambers.

Water is typically flowed into the chamber at the first end of the string; and thus it is common to have a provision in the end plate for receiving one or more influent flow pipes, which may approach at no particular angle. At times, it is necessary to connect one chamber string to another spaced apart string, where the second string which might run parallel, perpendicular, or at some other angle to the first string. That connection between such chamber strings is frequently made by means of drainpipes penetrating the endplates.

For instance, U.S. Pat. No. 5,839,844 for a leaching chamber endplate and U.S. Pat. No. 5,017,041, for a leaching chamber, both to Nichols et al., show different kinds of flat endplates, which attach to the end of the chamber. As shown by the patents, in the prior art, provisions have been made in endplates, such as a cutout hole, or an embossing for a hole-cut, with the expectation that a pipe will lie substantially parallel to the axis as the chamber. In the prior art, when the drain pipe does not lie close to the extension of the lengthwise axis of the chamber, then plumbing fittings in the drain pipe are used, to make the connection. Particularly in leaching chamber applications, where the wastewater tends to carry solids, it is desirable to minimize any sharp bends in the drain line. It is desirable, for reason of labor and material costs to avoid plumbing work at the job site and to speed installation.

SUMMARY

An object of the invention is to provide an end cap for an arch shape cross section chamber which enables easy connection of pipe lines coming toward the chamber at varying angles, and which thus minimizes the number of fittings necessary in the drain line. A further object is to provide such an end cap in a form which is structurally strong, is adapted to economical plastic molding, and which can be nested for economic shipment.

In accord with the invention, an end cap for an arch shape cross section leaching chamber or storm water chamber, has an end flange for engaging the end cap with a chamber; a base flange for supporting the end cap on soil; a shell, preferably a convex exterior surface shape dome, connecting the base flange with the end flange; and at least one buttress, preferably a multiplicity of buttresses, extending outwardly from the exterior of the dome shape surface, and running upwardly from the base flange. Each buttress has a surface portion, preferably an essentially planar surface portion, which is adapted for receiving a pipe through which water may be flowed to or from the interior of the end cap.

Preferably, the end cap is comprised of five buttresses. There are first and a second buttress having planar surfaces facing in opposing y axis directions, and a third buttress having a planar surface facing in the x axis direction, i.e., of the lengthwise axis of the end cap, which corresponds with the lengthwise axis of a chamber to which the end cap attaches. Fourth and fifth buttresses are interspersed between the first, second and third buttresses. They face at angles intermediate to the other buttresses, preferably at nominally 45 degrees angles to the x axis in the x-y plane of the base flange of the end cap.

Preferably, the buttresses run down to the base flange, and at least one of the buttresses has a step formed by slightly displaced planes running along the face of the buttress. The step forms a saddle for supporting a pipe inserted in a hole in said planar face. And a sub-saddle bisects the saddle, to support a pipe having a substantially smaller diameter than the pipe which is supportable by the saddle. Preferably, at least one buttress has three slightly displaced planes, to form two steps therebetween and two saddles, one for supporting a pipe at a high elevation near the top, and one for supporting a pipe near the base flange. Preferably, the planar face of the buttress has an embossed seal with a pull-tab, so a circular piece can be torn out of the face, to create a hole for a pipe. Preferably, the base flange of the end cap, in front of a planar face of a buttress, has perforations for receiving the tabs of a splash plate which projects into the interior of the end cap.

The foregoing and other objects, features and advantages of the invention will become more apparent from the following description of preferred embodiments and accompanying drawings.

DESCRIPTION

U.S. Pat. No. 5,839,844 "Leaching Chamber Endplate" of Nichols et al. and U.S. Pat. No. 6,602,023 of Crescenzi et al., also entitled "Leaching Chamber Endplate" disclose details of how leaching chamber endplates are used in combination with chambers. U.S. patent application Ser. No. 09/949,768, "Storm Water Management System" of Krueger et al., filed May 4, 2001, and related application Ser. No. 10/402,408, filed Mar. 28, 2003, describe stormwater chamber and end plate use. See also patent application No. 10/677,938 "Corrugated Leaching Chamber" of the present applicants Brochu, Burnes and others, filed on even date herewith, which describes a new corrugated leaching chamber, with which the end cap of the present invention is particularly useful. The end cap of the present invention can be used with the chambers described in the foregoing patent applications and the other patents referenced therein. The drawings and descriptions in the foregoing patents, which are commonly assigned herewith, are hereby incorporated by reference.

Figure 1:
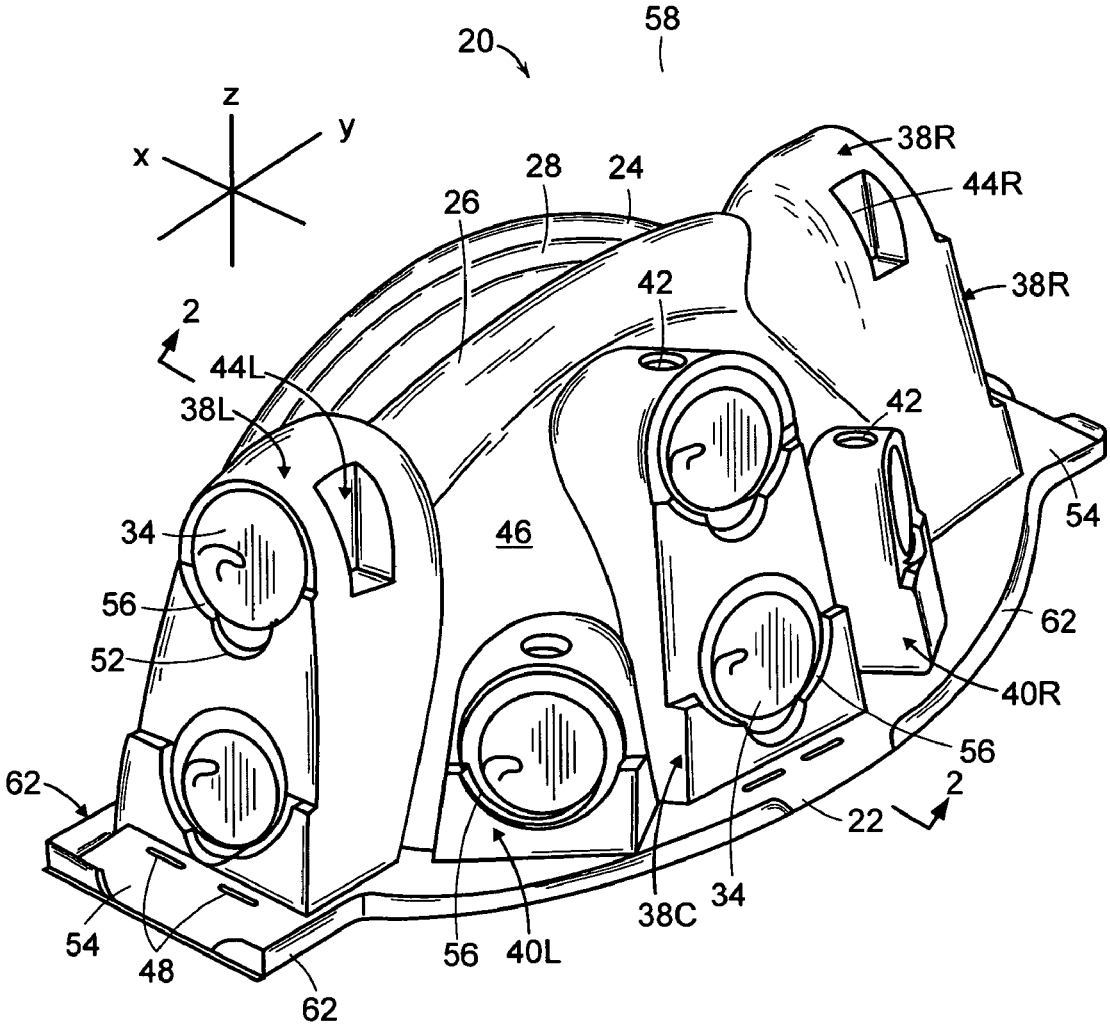
FIG. 1 shows an end cap in isometric view along with associated orthogonal reference axes.
Figure 2:
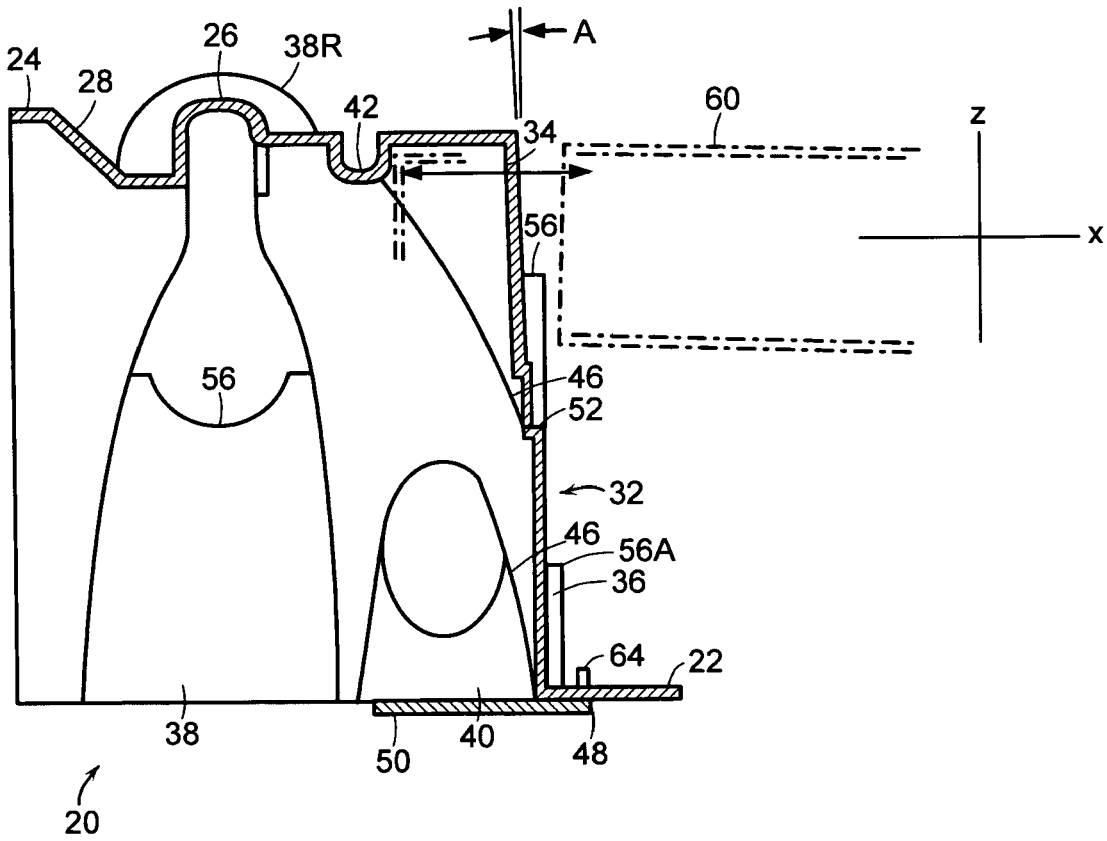
FIG. 2 is a longitudinal vertical centerline cross section through the end cap of FIG. 1.

FIG. 1 is a perspective view of an end plate 20. FIG. 2 is a vertical centerplane cross section of the end cap. Endplate 20 has a flanged base 22, for supporting the end cap against vertical load when it is attached to the end of a leaching or stormwater chamber. The end flange 24 is curved, and shaped for attachment to a continuous curve semi-elliptical cross section chamber like that described in the aforementioned Krueger et al. and Brochu et al. patent applications. Other shape of end flange may be used, to mate with other chamber end cross sections, such as those shown in the patents referenced above.

The shell 46 of the end cap has the essential shape of a dome, that is an inward curving structure, from which buttresses project. Transition section 28 leads from the curved dome surface 46 to the end flange. Corrugation 26 runs transversely to the longitudinal x axis of the end cap and to the chamber to which it mates, for strength. Five buttresses 38L, 38R, 38C, and 40L and 40R rise from the dome surface 46, to present planar surfaces, or facets, where pipes may be made to penetrate the end cap. Such pipes will be used to deliver or remove liquid from inside a chamber to which the dome is attached. Generally, large diameter pipes are associated with gravity flow systems. Sometimes, liquid is introduced by pump pressure, and smaller diameter pipes suffice. The suffixes L and R designate mating buttresses on opposing sides of the vertical lengthwise x-z centerplane. Suffix C designates the center buttress. The three buttresses 38 are similar, as are the two buttresses 40. Buttresses 40 are smaller than buttresses 38, to provide sufficient curved dome area between buttresses 38, which gives the end cap adequate structural strength without the need for strengthening ribs.

FIG. 1 and 2 show that end flange 24 lies in the vertical y-z plane; and that bottom flange 22 lies in the horizontal x-y plane. The bottom flange runs from the bottom ends of the end flange, along the bottom of shell 46, and extends outwardly from the y-z plane. *Fig.* 1 shows how buttresses 38L, 38C, 38R, 40L, 40R and their outward-facing surface portions run upwardly from the bottom flange 22.

Figure 3:
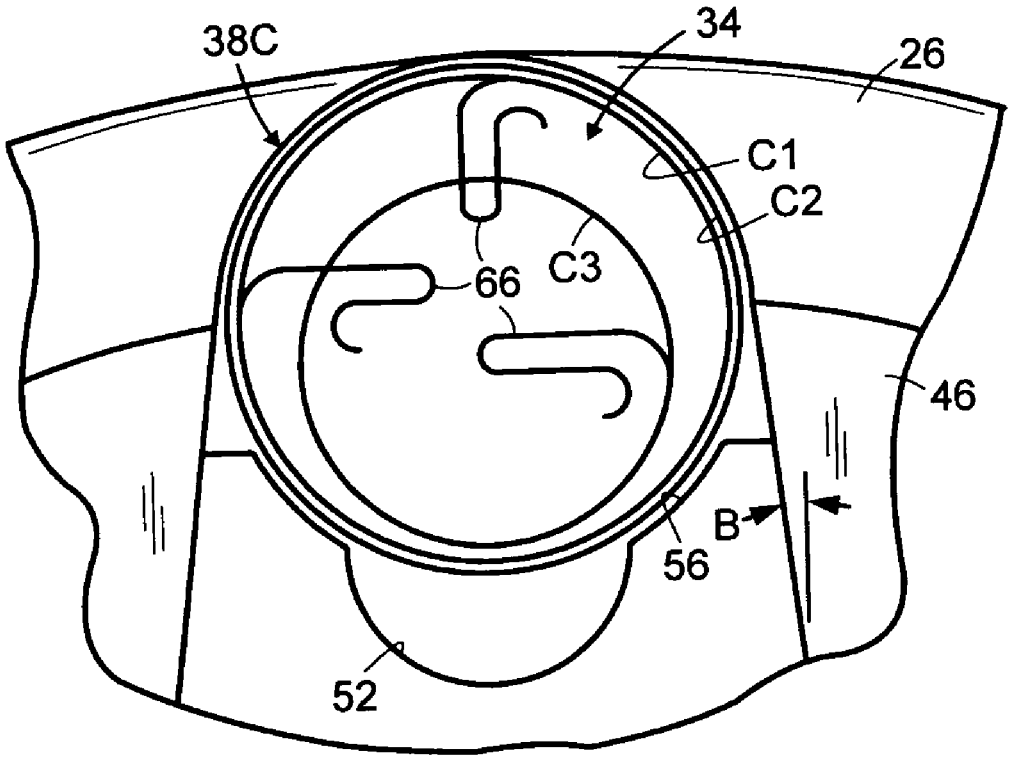
FIG. 3 shows a portion of a buttress, with a seal that can accommodate different diameters of pipes.

The buttresses have several features in common, as follows. Referring to buttresses 38, each has an essentially planar region 34, shaped in dimension sufficiently to receive a selected diameter pipe running perpendicular thereto. Typically, the end cap is provided without any hole in buttress region 34, and the installer in the field makes openings where pipe connection is desired. For instance, a hole saw or knife may be used to selectively remove a portion of region 34 and create a circular hole through which a pipe may enter. As shown in FIG. 3, region 34 is preferably embossed or scored, to define different diameter circles C1, C2 and C3. The plastic segments within one of the circles are removed by means of pull-out tabs 66 to create a suitable opening. An embossed or otherwise configured hole is often referred to as a seal or seal assembly. Obviously, a close fit with the pipe is desired, to prevent infiltration of soil. For examples of seals that may be used, see U.S. Pat. No. 5,882,014 to Gavin and the references thereof. Preferably, end cap 20 has a seal like those described in patent application No. 10/677,769 "Pipe Seal Made of Molded Thermoplastic" of Brochu et al, filed on even date herewith, the disclosure of which is hereby incorporated by reference. In the generality of the invention, the surface portions of buttresses 38, 40 which receive pipes need not be planar, but may have other more complicated or contoured shapes When a certain larger diameter pipe 60, shown in phantom in FIG. 2, is passed through an opening created in region 34, inward penetration of the pipe is limited by contact of the top portion of the pipe with molded stop 42. Buttresses 40 have similarly configured stops. Buttresses 38L, 38R have differently shaped, but analogously functioning, molded in stops 44L, 44R.

The exterior planar surfaces of all the buttresses are essentially vertical, having a slight slope inward, toward the vertical z axis, at about a six degree angle A, so that end caps will nest with each other for compact shipment. See FIG. 2. Similarly, the sides of the buttresses slope inwardly at an about six degree angle B from the vertical. See FIG. 3. When viewed head-on, the planar face of buttress 38 has the nominal shape of a truncated triangle with a curved apex. See FIG. 3. The sides, face and top of buttresses may be shaped differently, for instance, with non-curved top, with differently sloped sides and face, in the context of the generality of the invention, where a buttress is structure attached to and projecting from the surface of an endplate, to provide a nominally vertical surface for a pipe connection.

The buttresses have molded in saddles 56, 52, for supporting pipes against vertical down loads. The saddles result from by slightly displaced planar segments of the essentially vertical faces of the buttresses. Buttresses 38 have three displaced planar portions, while buttresses 40 have two.

Saddles 56 on buttresses 38 are comprised of two spaced apart pads, bisected by sub-saddle 52. Each buttress 38 has two sets of such saddles, so pipes may be received and supported near the base and near the top of the end cap.

As will be appreciated from FIG. 3, saddle 56 will support any of the pipes having diameters of circles C1, C2 or C3, or in-between. For example pipes of nominally 3 and 4 inch diameter will be supported on saddles 56. Sub-saddle 52 of buttresses 38 provides support for a smaller diameter pipe, for instance a nominal 1 to 2 inch diameter pipe, which might be a pressure dosing pipe. Buttresses 40 have similar but continuous saddles 56A. Different combinations or configurations of saddles may be used. In the generality of the invention buttresses may have a simple planar face and no steps and no saddles; and, the term "planar facet surfaces" is intended to encompass surfaces which are only essentially planar, and not perfectly planar. For instance, regions 34 can curve inwardly slightly as they rise upwardly; or they might be somewhat concave or convex.

The five buttress design of end cap 20 is preferred for maximum flexibility in the field. The faces of buttresses 40 run at 45 degrees to the lengthwise centerline or x axis of the end cap, when looking down into the x-y plane. The opposing faces of buttresses 38R and 38L lie along the y axis; thus are parallel to the x axis. The face of buttress 38C lies along the x axis. The combination of corrugation 26, buttresses, and saddles, provides good strength to the end cap, to support vertical loads, without interior ribbing of the type commonly known as necessary heretofore. Thus, the end caps nest well for shipment.

Other combinations of buttresses may be used. Compared to chamber 20, in the generality of the invention, fewer buttresses, and buttresses having planar faces running at different angles than 0, 45 and 90 degrees to the x axis may be used. For example a faceted end cap may have only two buttresses, for instance, buttress 38C and 38R, running at 90 degree angles, or some other angle. Alternately, buttresses 38 may be present without buttresses 40. Other variations in buttress arrangement and configuration will be apparent. In the generality of one mode of the invention, there is at least one buttress, 38 or 40, having a stepped face to provide saddles. Buttresses may be mounted A pipe which penetrates through an appropriate good fit hole in region 34 may be angled relative to the nominal plane of region 34 of a buttress, by as much as 10–20 degrees. This is achieved by making the buttresses interior dimension sufficiently wide at the point where the pipe is located, so the buttress sidewall allows the pipe stub inside the chamber to move sideways. The bendable character of the sheet material, which comprises region 34, also enables the motion. Thus, with the preferred embodiment, pipes coming from virtually 180 degree arc direction can be accommodated.

Figure 4:
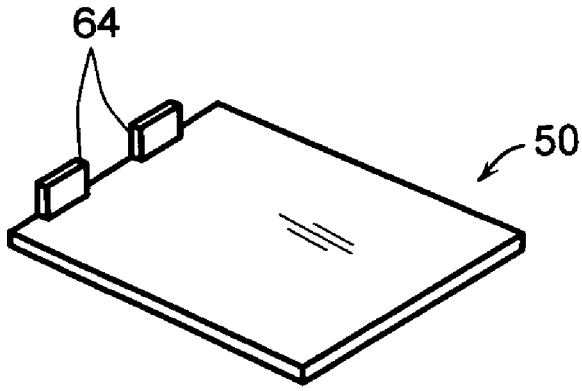
FIG. 4 shows a splash plate, which optionally may be connected to the base flange of an end cap.

Bottom flange 22 has a vertically extending fin 62 for strengthening. Apron areas 54 in front of the bases of buttresses 38 provide further "footprint" for bearing vertical loads. Two slots 48, for receiving the tabs of a splash plate 50, are present in the apron areas 54 of the base flange, at the bottom of the front face of each buttress 38. Other slots, not shown, may be present with respect to buttresses 40. Optional molded splash plate 50, shown in FIG. 4, has two tabs 64, shaped to fit into the slots 48. In the field, splash plate 50 is placed beneath the bottom flange of the end plate so it extends into the interior of the chamber, as illustrated in FIG. 2. Splash plate 50 helps prevent erosion of underlying soil, when water drops from a pipe inserted into an upper elevation buttress opening.

In use, the end cap is attached to the end of a leaching or storm water chamber. One or more of the embossed regions is pulled out, suitable for the diameter of pipe being used the opening so it contacts the stop, where there is a stop associated with the opening. The chamber is then covered over with gravel, soil or other media and water is flowed from the pipe into the interior of the end cap and the chamber.

The stepped configuration of the buttress face, which provides the saddles for pipes, which have been described, may be applied to articles other than end caps, for instance, to chambers, distribution boxes, and any other molded articles where pipes are connected.

The stepped configuration of the buttress face, which provides the saddles for pipes, which have been described, may be applied to articles other than end caps, for instance, to chambers, distribution boxes, and any other molded articles where pipes are connected.

The preferred end cap is made of injection molded thermoplastic, such as polypropylene or high density polyethylene, materials well known in the art, with a wall thickness which will vary with location, but will typically be in the range 0.090 to 0.125 inch. Other thickness may be used; as may other materials of construction, for example, structural foam plastic.

Figure 5:
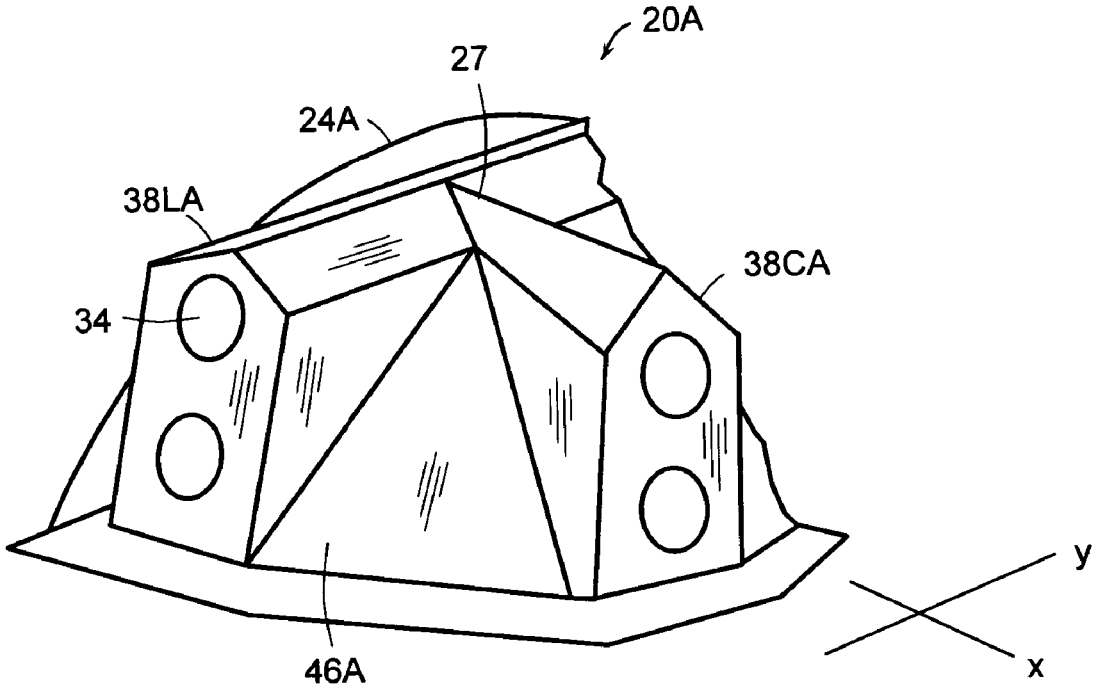
FIG. 5 is a partial isometric view of an end cap comprising planar surface housing

The shell 46 is preferably a convex continuous curved dome surface, as has been shown. In the generality of the invention, other shape surfaces may be used to form shell of the end cap. For example, FIG. 5 shows a major portion of end cap 20A, where shell 46A comprises slanted planes, which converge at the top 27 of the end cap. Three planar sided buttresses, two of which are shown, 38LA and 38CA, extend upwardly from the base flange and outwardly from the surface of shell 46A. As with the preferred embodiment end cap 20, less or more buttresses may be present on end cap 20A. When present, small buttresses, like buttresses 40, will strengthen the planar parts of the shell which run between the larger buttresses.

Although this invention has been shown and described with respect to one or more preferred embodiments, and by examples, those should not be considered as limiting the claims, since it will be understood by those skilled in this art that various changes in form and detail thereof may be made without departing from the spirit and scope of the claimed invention.

We claim:

1. An end cap for closing off the open end of an arch shape cross section leaching chamber or storm water chamber, having x, y and z axes, which comprises:

an arch shape first end lying in a vertical y-z plane, for mating the end cap with the end of a chamber;

a second end, lying in horizontal x-y plane, for supporting the end cap on a surface, having a contour which runs outwardly from the plane of the first end;

a shell having a convex shape exterior surface, connecting the first end and the second end; and, at least three buttresses, projecting outwardly from the exterior surface of the shell, the first buttress lying along the x-axis; the second and third buttresses disposed on opposing sides of the shell relative to the first buttress;

each buttress comprising a surface portion shaped for receiving a pipe through which water may be flowed to or from the interior of the end cap;

wherein each buttress surface portion faces in a horizontal plane direction which is different from the others; and wherein the surface portion of at least one buttress comprises two sub-portions, one above the other, the sub-portion surfaces slightly displaced relative to each other, to form a step therebetween.

2. The end cap of claim 1, wherein the step of said least one buttress is curved, to form a saddle for supporting a pipe.

3. The end cap of claim 2 further comprising a sub-saddle at the mid-point of said saddle.

4. An end cap for closing off the open end of an arch shape cross section leaching chamber or storm water chamber, having x, y and z axes, which comprises:

an arch shape first end lying in a vertical y-z plane, for mating the end cap with the end of a chamber;

a second end, lying in horizontal x-y plane, for supporting the end cap on a surface, having a contour which runs outwardly from the plane of the first end;

a shell having a convex shape exterior surface, connecting the first end and the second end; and, at least five buttresses, projecting outwardly from the exterior surface of the shell, a first buttress lying along the x-axis; the second and third buttresses disposed on opposing sides of the shell relative to the first buttress; a fourth buttress positioned between the second and first buttresses; and, a fifth buttress positioned between the first and third buttresses;

each buttress comprising a surface portion shaped for receiving a pipe through which water may be flowed to or from the interior of the end cap;

wherein each buttress surface portion faces in a horizontal plane direction which is different from the others.

5. The end cap of claim 4, wherein the shell exterior surface is curved.

6. The end cap of claim 4 wherein each buttress surface portion runs upwardly from elevation of the second end.

7. The end cap of claim 4 wherein the surface portion of each buttress is shaped as a truncated triangle with a curved apex.

8. The end cap of claim 4 wherein the second and third buttress surface portions face in opposing directions, each direction at an about 90 degree angle to the direction of the first buttress surface portion.

9. The end cap of claim 4, wherein the fourth and fifth buttresses are each smaller in height than the adjacent buttreses.

10. The end cap of claim 4, wherein the second and third buttress surface portions face in opposing directions, at an about 90 degree angle to the direction of the first buttress surface portion; and, wherein the fourth and fifth buttresses each face at an about 45 degree angle to the direction of the first buttress surface portion.

11. An end cap for closing off the open end of an arch shape cross section leaching chamber or storm water chamber, having x, y and z axes, which comprises:

an arch shape first end lying in a vertical y-z plane for mating the end cap with the end of a chamber;

a second end, lying in horizontal x-y plane, for supporting the end cap on a surface, having a contour which runs outwardly from the plane of the first end;

a shell having a convex shape exterior surface, connecting the first end and the second end; and, at least three buttresses, projecting outwardly from the exterior surface of the shell, the first buttress lying along the x-axis; the second and third buttresses disposed on opposing sides of the shell relative to the first buttress;

each buttress comprising a surface portion shaped for receiving a pipe through which water may be flowed to or from the interior of the end cap;

wherein each buttress surface portion faces in a horizontal plane direction which is different from the others; and, wherein the surface portion of at least one buttress has one or more embossed circles which define sections of the surface portion which may be manually cut or torn away, to provide a hole in the buttress for a pipe.

12. An end cap for closing off the open end of an arch shape cross section leaching chamber or storm water chamber, having x, y and z axes, which comprises:

an arch shape first end lying in a vertical y-z plane, for mating the end cap with the end of a chamber;

a second end, lying in horizontal x-y plane, for supporting the end cap on a surface, having a contour which runs outwardly from the plane of the first end;

a shell having a convex shape exterior surface, connecting the first end and the second end; and, at least three buttresses, projecting outwardly from the exterior surface of the shell, the first buttress lying along the x-axis; the second and third buttresses disposed on opposing sides of the shell relative to the first buttress;

each buttress comprising a surface portion shaped for receiving a pipe through which water may be flowed to or from the interior of the end cap;

wherein each buttress surface portion faces in a horizontal plane direction which is different from the others;

further comprising at least one stop inside at least one buttress, for limiting the inward motion of a pipe inserted though a hole cut in the surface portion thereof.

13. An end cap for closing off the open end of an arch shape cross section leaching chamber or storm water chamber, having x, y and z axes, which comprises:

an arch shape first end lying in a vertical y-z plane, for mating the end cap with the end of a chamber;

a second end, lying in horizontal x-y plane, for supporting the end cap on a surface, having a contour which runs outwardly from the plane of the first end;

a shell having a convex shape exterior surface, connecting the first end and the second end; and, at least three buttresses, projecting outwardly from the exterior surface of the shell, the first buttress lying along the x-axis; the second and third buttresses disposed on opposing sides of the shell relative to the first buttress;

each buttress comprising a surface portion shaped for receiving a pipe through which water may be flowed to or from the interior of the end cap;

wherein each buttress surface portion faces in a horizontal plane direction which is different from the others; wherein the base flange has perforation means for receiving a splash plate; further comprising: a splash plate extending into the interior of the chamber, the plate having tabs inserted into said perforations.

14. An end cap for closing off the open end of an arch shape cross section leaching chamber or storm water chamber, having x, y and z axes, which comprises:

an arch shape first end lying in a vertical y-z plane, for mating the end cap with the end of a chamber;

a second end, lying in horizontal x-y plane, for supporting the end cap on a surface, having a contour which runs outwardly from the plane of the first end;

a shell having a convex shape exterior surface, connecting the first end and the second end; and, at least five buttresses, projecting outwardly from the exterior surface of the shell; the first buttress lying along the x-axis; the second and fourth buttresses disposed on one side of the shell with respect to the first buttress; and the third and fifth buttresses disposed on the opposing side of the shell relative to the first buttress;

each buttress comprising a surface portion shaped for receiving a pipe through which water may be flowed to or from the interior of the end cap;

wherein each buttress surface portion faces in a horizontal plane direction which is different from the others.

15. The end cap of claim 14 further comprising: at least one stop inside at least one buttress, for limiting the inward motion of a pipe inserted though a hole cut in the surface portion of the buttress.

* * * * *